US010483669B2

(12) United States Patent
Petit et al.

(10) Patent No.: US 10,483,669 B2
(45) Date of Patent: Nov. 19, 2019

(54) UNITARY RF CONNECTOR FOR A BOARD-TO-BOARD CONNECTION AND A GANGED CONNECTOR INCLUDING A PLURALITY OF SUCH UNITARY CONNECTOR, FOR A MULTIPLE BOARD-TO-BOARD CONNECTION

(71) Applicant: RADIALL, Aubervilliers (FR)

(72) Inventors: Laurent Petit, Gieres (FR); Shan Qin, Shanghai (CN); Gong Chen, Shanghai (CN)

(73) Assignee: RADIALL, Aubervilliers (FR)

( * ) Notice: Subject to any disclaimer, the term of this patent is extended or adjusted under 35 U.S.C. 154(b) by 0 days.

(21) Appl. No.: 15/761,863

(22) PCT Filed: Sep. 28, 2015

(86) PCT No.: PCT/CN2015/090933

§ 371 (c)(1),
(2) Date: Mar. 21, 2018

(87) PCT Pub. No.: WO2017/054106

PCT Pub. Date: Apr. 6, 2017

(65) Prior Publication Data

US 2018/0261938 A1 Sep. 13, 2018

(51) Int. Cl.
*H01R 12/71* (2011.01)
*H01R 13/24* (2006.01)
(Continued)

(52) U.S. Cl.
CPC ..... *H01R 12/714* (2013.01); *H01R 12/91* (2013.01); *H01R 13/2442* (2013.01);
(Continued)

(58) Field of Classification Search
CPC .. H01R 12/714; H01R 13/41; H01R 13/6581; H01R 13/514; H01R 13/6471;
(Continued)

(56) References Cited

U.S. PATENT DOCUMENTS 4,453,797 A * 6/1984 Hollingsead ..... H01R 13/74 248/27.1
4,511,196 A * 4/1985 Schuler ..... H01R 23/6873 29/842
(Continued)

FOREIGN PATENT DOCUMENTS

CN 101964463 A 2/2011
CN 102044812 A 5/2011
(Continued)

OTHER PUBLICATIONS

International Search Report dated Jun. 30, 2016 from corresponding International Application No. PCT/CN2015/090933.
(Continued)

*Primary Examiner* — Travis S Chambers
(74) *Attorney, Agent, or Firm* — Pearne & Gordon LLP

(57) ABSTRACT

The present invention relates to a unitary RF connector (1), intended in particular to link two printed circuit boards (PCB1, PCB2), comprising: —a central rigid RF line (A) comprising a conductive element (30, 40, 50) retained within an electrical insulating body (2) which is rigid; —at least one flexible RF line (B1, B2) comprising a conductive element (31, 32; 41, 42; 51, 52) linked to the conductive element (30, 40, 50) of the central rigid line (A) and being able to flex toward one of the end face (21, 22) of the insulating body taking any closer position when acted upon by the pressure force of a complementary connection element (PCB1, PCB2).

17 Claims, 8 Drawing Sheets

(51) Int. Cl.

| | |
|---|---|
| ***H01R 12/91*** | (2011.01) |
| ***H01R 13/41*** | (2006.01) |
| ***H01R 13/514*** | (2006.01) |
| ***H01R 13/6581*** | (2011.01) |

(52) U.S. Cl.
CPC ..... *H01R 13/41* (2013.01); *H01R 13/514* (2013.01); *H01R 13/6581* (2013.01)

(58) Field of Classification Search
CPC .... H01R 13/2442; H01R 12/73; H01R 12/00; H01R 12/52; H01R 12/716; H01R 12/91; H01R 13/2435; H01R 13/6315; H01R 13/6585; H01R 13/6587
USPC ..... 439/607.01, 66, 289, 63, 74, 247, 248, 439/607.09, 607.1
See application file for complete search history.

(56) References Cited

U.S. PATENT DOCUMENTS

| | | | | |
|---|---|---|---|---|
| 5,380,210 | A * | 1/1995 | Grabbe | H01R 13/2435 439/66 |
| 6,231,352 | B1 * | 5/2001 | Gonzales | H01R 12/52 439/66 |
| 6,896,535 | B2 * | 5/2005 | Yamada | H01R 12/714 439/289 |
| 7,985,077 | B2 * | 7/2011 | Di Stefano | H01R 4/027 439/439 |
| 8,016,614 | B2 | 9/2011 | Xie et al. | |
| 8,535,093 | B1 * | 9/2013 | Mason | H01R 13/6585 439/607.05 |
| 9,059,545 | B2 * | 6/2015 | Mason | H01R 12/714 |
| 9,065,216 | B2 * | 6/2015 | Chang | H01R 13/6585 |
| 10,294,968 | B2 | 5/2019 | Hoey | |
| 2003/0124879 | A1 * | 7/2003 | Ng | H01R 12/714 439/66 |
| 2008/0160841 | A1 | 7/2008 | Polnyi et al. | |
| 2010/0112829 | A1 * | 5/2010 | Yasamura | H01R 13/2407 439/66 |
| 2013/0065447 | A1 | 3/2013 | Luo et al. | |
| 2013/0237091 | A1 | 9/2013 | Mason | |
| 2013/0330969 | A1 | 12/2013 | Avery et al. | |

FOREIGN PATENT DOCUMENTS

| | | | |
|---|---|---|---|
| CN | 102377058 | A1 | 3/2012 |
| CN | 104 348 053 | A | 2/2015 |
| JP | 2012-227086 | A | 11/2012 |
| WO | 2010/010524 | A1 | 1/2010 |
| WO | 2010/135980 | A1 | 12/2010 |

OTHER PUBLICATIONS

Written Opinion dated Jun. 30, 2016 from corresponding International Application No. PCT/CN2015/090933.
Extended European Search Report for Application No. 15905018.6, dated Apr. 5, 2019.
Department of Defense, United States of America, MIL STD 348 ed. 2014: Department of Defense Interface Standard: Radio Frequency Connector Interfaces, Aug. 17, 2014, pp. 1-222.
Radiall, RF & Microwave Cable Assemblies, C291—Catalog, available at https://www.radiall.com/media/files/SMP_SMP-MAX%20D1C004XEe.pdf, last visited Aug. 23, 2019.
Huber + Suhner, Inc., SMP Connectors—Catalog, available at https://www.hubersuhner.com/en/solutions/space/products/microminiature-connectors/smp, last visited Aug. 23, 2019.
Rosenberger, PCB Connectors, Solutions for Board to Board Connection—Catalog, available at https://www.rosenberger.com/0_documents/de/catalogs/ba_communication/COM_PCB_Flyer_2011.pdf, last visited Aug. 23, 2019.
Huber + Suhner, Inc., MMBX Connectors, available at https://www.hubersuhner.com/en/solutions/energy/products/board-to-board-connectors/mmbx, last visited Aug. 23, 2019.
Radiall, MMBX Connectors, available at https://www.radiall.com/products/rf-coaxial-connectors/snap-on-connectors/mmbx.html, last visited Aug. 23, 2019.

* cited by examiner

UNITARY RF CONNECTOR FOR A BOARD-TO-BOARD CONNECTION AND A GANGED CONNECTOR INCLUDING A PLURALITY OF SUCH UNITARY CONNECTOR, FOR A MULTIPLE BOARD-TO-BOARD CONNECTION

FIELD OF THE INVENTION

The present invention relates to a unitary RF connector.

Such a unitary connector can be used in particular to link two parallel printed circuit boards, usually called a board-to-board connection or even a printed circuit board (PCB) to another component such as a module or a filter.

The invention applies, for example, to a connection used to link boards inside RRU/RRH (remote radio unit/remote radio head) transmitter modules for the wireless communications market.

The invention also relates generally to the connection in the medical domain, the aeronautical or transport domain, the space domain or even the telecommunications domain.

By "RF connector", it is to be understood a connector able to transmit signals from the Direct Current (DC) range to the radiofrequency (RF) range, including the hyperfrequency (HF) range, the signals being high speed digital signals (HSDL for High Speed Data Link) or radiofrequency (RF) signals.

BACKGROUND OF THE INVENTION

With the continuous development of wireless communication technology, board to board connectors are becoming more and more widely used in wireless system module interconnection, such as communication base station, RRH, repeater, GPS devices, and other similar applications. Three major trends of wireless devices are smaller dimension, lower cost, and easier installation. For a board to board connection, the market also requires them to be smaller, cheaper and more modularized.

In particular, there are already on the market and in the prior art examples of connection assemblies dedicated to the telecommunications sector for cellular radiotelephony infrastructures. In fact, the trend in this market is to minimize the losses of the RF (radiofrequency) part in order to reduce the amplifying elements of the base stations. For this, on the one hand, the actual radio part of the stations is being increasingly relocated as close as possible to the transmission-reception antennas, in the RRU/RRH transmitter modules, and on the other hand, the RF leads internal to the radio unit are being replaced by direct interconnections.

So-called board-to-board connections have thus been developed according to the successive generations of the last decade.

A first generation of connection assemblies is thus known, for directly interconnecting boards, for example marketed under the names SMP, SMP-Com, MMBX from Radiall. Such connection assemblies respectively consist of a first socket of snap-fitting (or "snap") type, a second socket of "sliding" (or smooth bore) type with a guiding cone ("slide on receptacle"), and a connection coupling called adaptor, with the first and second sockets respectively fastened to the ends thereof. The connection is therefore made blind by the re-centring of the connection coupling by means of the guiding cone of the sliding socket. The major drawback is the great limitation on the axial and radial misalignments allowed for these connections. In practice, the axial misalignment is limited to a few tenths of a millimetre, of the order of 0.3 mm to 0.6 mm, in order to keep the impedance of the coaxial line at a value equal to 50 Ohm. The radial misalignment is obtained by a rotation of the coupling in the groove of the snap-fitting socket, this rotation being in fact relatively small to avoid damaging the central contact and the elastic means with which the connection coupling is provided.

A second generation of connection assemblies is also known, for example marketed under the names SMP-MAX by the company Radiall or else marketed under the names MBX by the company Suhner or else marketed under the name AFI by the company Amphenol RF, or else marketed under the name Long Wipe SMP and P-SMP by the company Rosenberger.

Such connections, to link two printed circuit boards, generally consist of three elements, namely: a first socket of sliding type, a second socket with snap-fitting or of retention type and a connection coupling with the first and second sockets respectively fastened to the ends thereof.

The first and second sockets are conventionally made of brass and have no elastic functions. The connection coupling is typically made of an expensive noble elastic metallic material, for example $CuBe_2$ or $BZ_4$, and provided at each of its ends with elastic means (petals and slots for example) that cooperate with the first and second sockets.

This second generation of connections made it possible to increase the accepted axial misalignment value. Thus, as described in particular in the patent application WO 2010/010524, this increase can result from an impedance compensation at the coupling end, which makes it possible to obtain a trade-off in mechanical and electrical efficiency regardless of the inclination of the coupling relative to the sockets.

All the known board-to-board connections do however present a significant number of drawbacks.

On the one hand, because the couplings of these connections have elastic means generally consisting of petals at their ends, they can be fragile. Thus, it is commonplace, when connecting blind, for the coupling to be damaged when it comes into contact with the guiding cone of a sliding socket.

On the other hand, the configuration of the connections does not make it possible to obtain a sufficiently great radial and/or axial misalignment. In particular, significant rotation angles, typically greater than 3.5°, cannot be reached without causing an undesirable permanent deformation of the elastic means of the coupling. This permanent deformation causes a significant degradation of the electrical performance levels (electrical continuity), which de facto limits the radial misalignment allowed, in particular for a small distance between boards to be connected.

At last, the cost of producing these connections is relatively high, thus constituting a brake for this type of market. In particular, producing the connection coupling from a noble material, in particular when the coupling has a significant length, and producing possible slots in this coupling results in not-inconsiderable production costs.

In the case of the connection assembly according to the patent application WO 2010/010524, said connection needs in fact three different pieces which are connector elements, namely two receptacles which are each soldered on a PCB and one elongated rigid coupling to connect together the two receptacles. When applied in massive board to board connection, it might result of this type of solution a very big insertion force and make the connection between two PCB difficult.

Another current solution to realize a board to board connection is described in U.S. Pat. No. 6,231,352B1. Though it adopts only one connector to realize the board to board connection, it still needs soldering process to fix each longitudinal end of the connector on the PCB. This solution is not convenient for maintenance, when applied in different board to board heights. Besides, once the maintenance is done, the connector needs to be redesigned, with an impedance that is not necessarily well controlled. This solution is not good for applications which require some modularization and standardization.

There is therefore a need to further improve the board to board connections, in particular by providing the minimum of pieces required for the connection, by allowing an installation with less solder in order to improve the installation efficiency, an easy maintenance with the possibility to easily extract the connection, a certain misalignment tolerance, a controlled impedance line with good RF performances, the possibility of an easy standardization and modularization and, at low cost.

The invention aims to address all or part of these needs.

SUMMARY OF THE INVENTION

Thus, the subject of the invention, according to one of its aspects, is a unitary RF connector, intended in particular to link two printed circuit boards, comprising:

- a central rigid RF line comprising a conductive element retained within an electrical insulating body which is rigid;
- at least one flexible RF line comprising a conductive element linked to the conductive element of the central rigid line and being able to flex toward one of the end face of the insulating body taking any closer position when acted upon by the pressure force of a complementary connection element.

In other words, the invention consists in defining a one-piece connector with an electrically insulating block which serves as a rigid support for flexible conductive elements whose central portions are rigidly respectively held therein and/or on the outer wall of the block.

In the preferred embodiment, the central rigid RF line is constituted by at least:

- the central portion of a first strip forming a central contact;
- the central portion of at least a second strip forming a ground contact.

According to this embodiment, the flexible RF line may be constituted by at least one free end of the first and the second strips.

In a variant, both free ends of each of the ground and the central contacts of the flexible RF line are incurved toward an end face the insulating body and being flexible such as they are each configured as a spring.

Alternatively, only one free end of each of the ground and the central contacts being flexible spring, the other free end of each of the ground and the central contacts being configured as a rigid tab in order to be weld to a contact of a complementary connection element.

According to an advantageous feature, each flexible end of the ground or central contact strip comprises an embossment forming a contact point.

The unitary RF connector according to the invention may comprise

- either one or two ground contacts retained outside the insulating body, or
- one or two ground contacts retained within the insulating body.

According to an advantageous variant, each of the end faces of the insulating body comprises grooves, each groove being capable of accommodating a flexible end of the conductive element(s) of the flexible line in order to mechanically protect said element(s) even in case of a high pressure force of the complementary connection element.

The unitary RF connector may comprise advantageously an electromagnetic shield, which is retained outside the insulating body.

The central portion of the ground contact(s) may be shaped as a shell surrounding the insulating body and forming the electromagnetic shield.

According to an advantageous variant, the shield comprising flexible cuts or tabs allowing a floating mounting of the unitary connector into a holder.

The central contact may be made of high strength bronze, such as CuBe2

The ground contact(s) and eventually the electromagnetic shield may be made of stainless steel.

The main advantages obtained by the RF unitary connector according to the invention are numerous and can be itemized as follows:

- compared to the connection solutions according to prior art, the number of solders is reduced for establishing contacts for a board to board connection, thus preventing soldering troubles in case of a multiple parallel interconnection;
- the possible transmission of high speed digital signals (HSDL for High Speed Data Link) or of radiofrequency (RF) signals up to 15 GHz thanks to the controlled impedance line of the unitary connector,
- when the distance between the two PCB to be connected changes, only the modification of the length of the connector is needed to meet the requirements, which is good for a standardization;
- the possible use of the unitary connector in a configuration with a holder in which it is arranged according to a floating mounting or soldered at one of its ends onto a PCB;
- the possible use of a plurality of unitary connectors in a ganged configuration with a holder in which they are arranged according to a floating mounting for a multiple parallel interconnection, which is good for a modularization;
- the facility of achieving different heights of board to board connections, by stacking different heights of the unitary connector;
- a good control of the electrical contact resistance and the misalignment tolerance thanks to the deflection of the free ends of the strips;
- the insertion and withdrawal force are drastically reduced in comparison to a usual interconnect assembly with pin-socket conventional contacts;
- the unitary connector can be easily extracted from the holder, which makes it quite convenient for the maintenance;
- the costs for realizing the unitary connector are very reduced compared to the connection solutions according to the prior art: for example.

According to another aspect, the invention concerns a connection module, intended to be used to link two printed circuit boards comprising:

- at least one unitary RF connector such as described above except of the variant with the rigid tab(s) to be weld;
- a holder comprising a frame with at least one opening in which a unitary connector is accommodated according to a floating mounting.

Advantageously, the frame comprises a plurality of openings arranged in a single plane in each of which a unitary connector is accommodated according to a floating mounting.

The frame may comprise also a plurality of openings arranged in at least two stacked planes in each of which the unitary connector is accommodated according to a floating mounting.

According to another aspect, the invention concerns the use of the unitary RF connector described above or a connection module described above, to transmit RF (radiofrequency) signals or HSDL (High Speed Data Link) signals.

At last, the invention is related to a process for manufacturing a unitary connector described above, comprising the following steps:

- stamping a sheet of metal, preferably a stainless steel, to shape the ground contact strip(s) and eventually the shell;
- stamping a sheet of metal, preferably a high strength bronze, to shape the central contact strip;
- positioning and maintaining the central contact strip relative to the ground contact strip(s);
- insert molding an insulating material to form the insulating body retaining inside the central portion of the central contact strip and outside the central portion of the ground contact strip(s).

BRIEF DESCRIPTION OF THE DRAWINGS

The invention will be able to be better understood on reading the following description of exemplary and non limiting implementations thereof, and on studying the appended figures in which:

FIGS. 1, 1A and show a first embodiment of a unitary radiofrequency (RF) connector 1 extending along a longitudinal axis X and comprising firstly an electrical insulating body 2 which is rigid.

Figure 1:
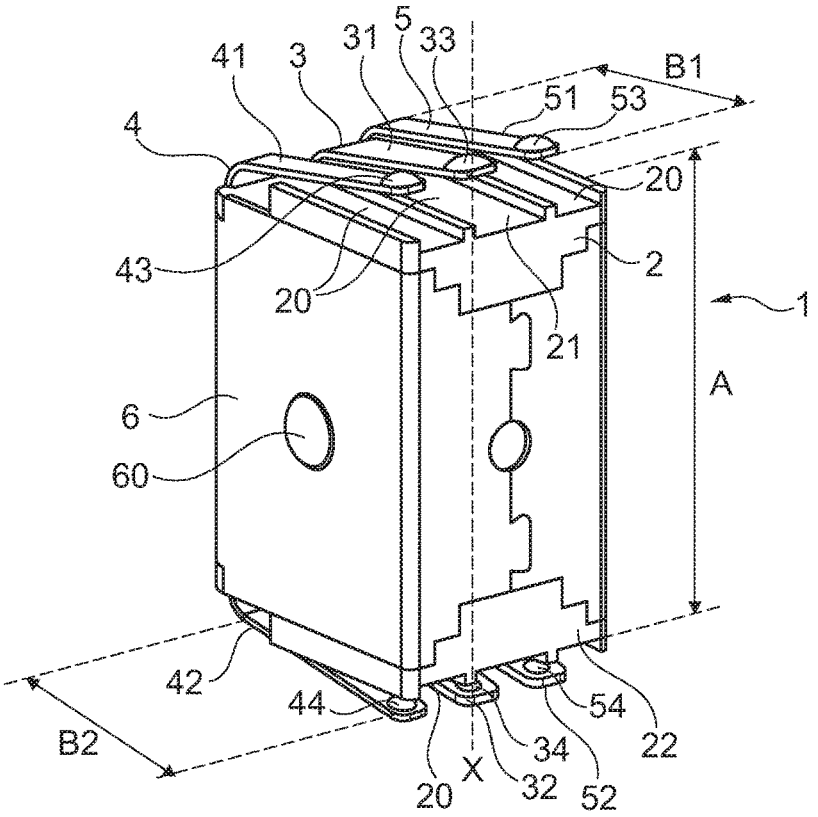
FIG. 1 is a perspective view of a unitary connector assembly according to a first embodiment of the invention.

A strip 3 forming a central contact comprises a central portion 30 which is retained inside the insulating body 2 and two free ends 31, 32 which are arranged outside the insulating body. Both free ends 31, 32 of the central contact 3 are each incurved toward an end face 21, 22 of the insulating body 2. Both free ends 31, 32 are flexible such as they are each configured as a spring. Each flexible end 31, 32 of the central contact strip 3 comprises an embossment 33, 34; forming a contact point.

Two other strip 4; 5 forming together the ground contact, are entirely arranged and retained outside the insulating body 2. The two free ends 41, 42; 51, 52 of each ground contact 4, 5 are incurved toward an end face 21, 22 the insulating body. They are arranged parallel to the free ends 31, 32 of the central contact strip 3. Both free ends 41, 42; 51, 52 are also flexible such as they are each configured as a spring.

From a RF point of view, each side of the flexible portions of the strips, 31, 41 and 51 on one hand, 32, 42 and 52 on the other hand, delimits a flexible RF line B1 or B2, such as shown on FIG. 1. Between these two flexible RF lines B1 and B2, a rigid RF line A is made of the insulation body 2 and of the portions 30, 40, 50 of the strips herein. In other words, in the illustrated embodiment of FIGS. 1 to 8, the unitary RF connector 1 comprises three RF lines, one rigid at its centre, and the two others flexible at its two ends. Of course, care is taken to control the impedance of these lines.

In a preferred embodiment; the central RF line A is dimensioned such that it can be described as a micro-strip line type. The conductive strips 3, 4, 5 have a typical thickness from 0.05 up to 0.25 mm and a typical width from 0.5 to 2.5 mm.

According to the invention, each of the contact springs 31, 32; 41, 42; 51, 52 is able to flex toward one of the end face 21, 22 of the insulating body 2 taking any closer position when acted upon by the pressure force of a complementary connection element.

Figure 1A:
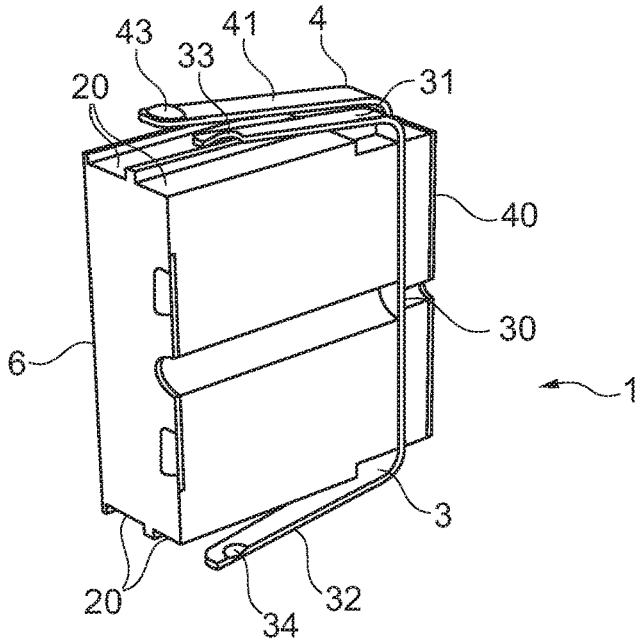
FIG. 1A is a longitudinal cross-sectional view of the unitary connector of FIG. 1, showing the accommodation of the central portion of the central contact.
Figure 2:
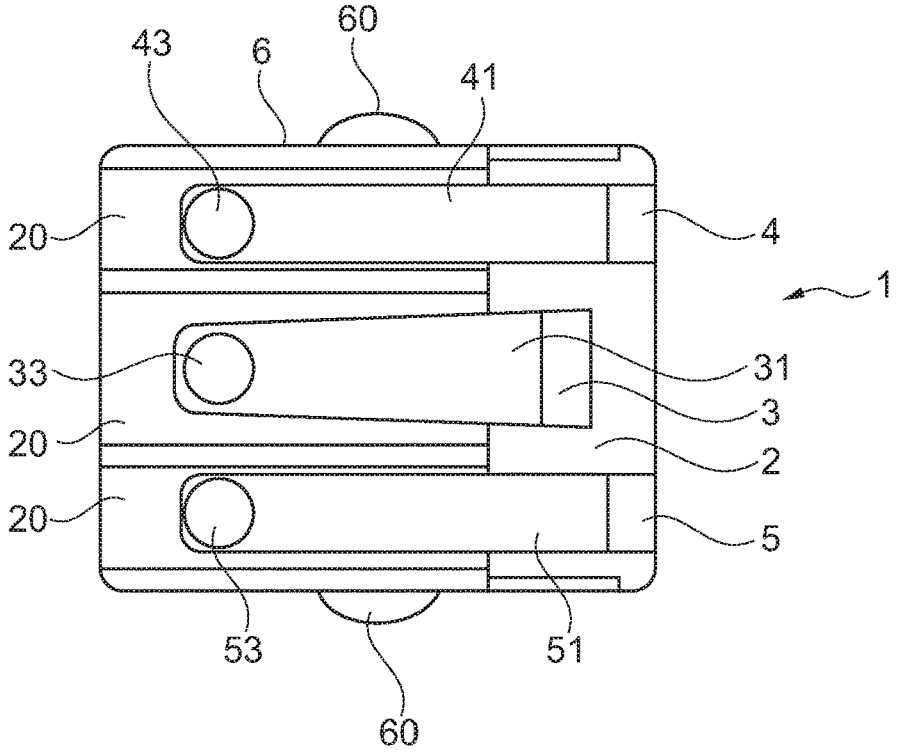
FIG. 2 is a top view of the unitary connector according to FIG. 1.

As shown in detail on FIGS. 1 and 1A, each of the end faces 21, 22 of the insulating body 2 comprises grooves 20. Each groove 20 is capable of accommodating a flexible end 31, 32; 41, 42; 51, 52 of the ground 4, 5 or the central 3 contact strips in order to mechanically protect said strips even in case of a high pressure force of the complementary connection element. In other words, even in the case of a maximal compression load induced by the displacement of a PCB in order to achieve a board-to-board connection, the strips are protected by their accommodation in the grooves which ensure their safety.

In an advantageous way, each flexible end 31, 32; 41, 42; 51, 52 of the ground or central contact strip comprises an embossment 33, 34; 43, 44; 53, 54 forming a contact point.

This contact point defines a precise electrical contact with a contact of a complementary connection element, such as a conductive track of a PCB.

Preferably, the central portion of the ground contacts 4, 5 are shaped as a shell 6 surrounding the insulating body 2 and forming an electromagnetic shield of the central rigid RF line A. In other words, the ground contacts 4, 5 are made in a single piece 6 in which not only the free ends 41, 42; 51, 52 are cut but also a protective shield.

Figure 3:
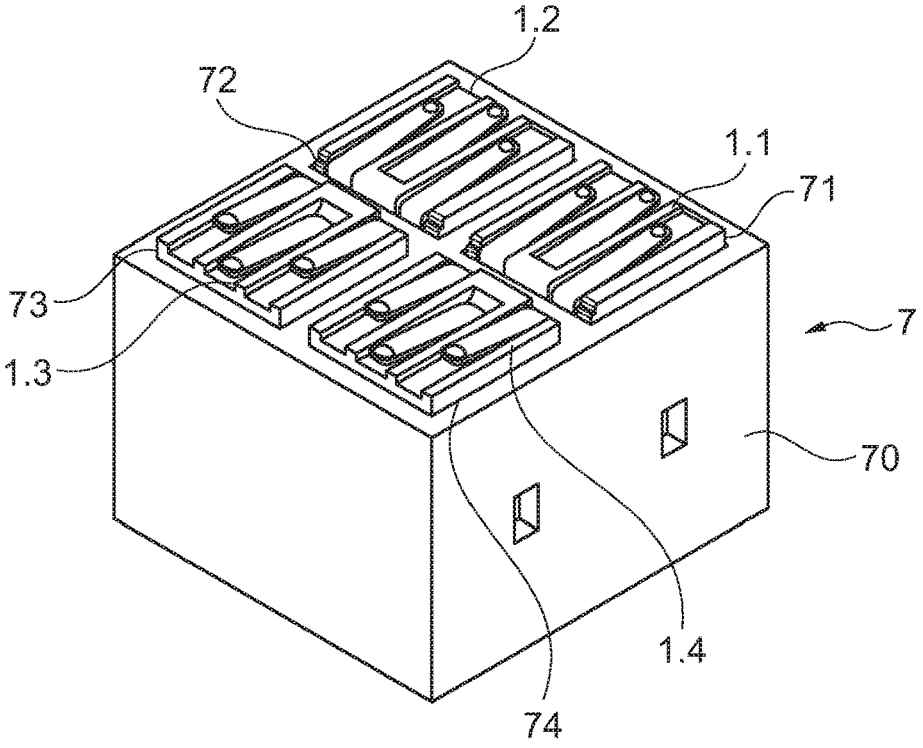
FIG. 3 is a perspective view of an exemplary connection module comprising four unitary connectors according to the invention, which are arranged in a common holder according to a floating mounting.

According to an advantageous variant shown on FIG. 3, it is provided a holder 7 which comprises a frame 70 with at least one opening 71, 72, 73, 74 in which at least a unitary connector is accommodated according to a floating mounting.

By "floating mounting", it is to be understood the usual technological meaning, i.e. a mounting allowing a certain displacement in translation of the unitary connector(s) into the frame.

In the illustrated example of FIG. 3, the floating mounting is ensured by flexible cuts 60 made in the lateral ends of the shell 6 which are in mechanical contact with the walls of an opening 71, 72, 73, 74 of the frame 70 of the holder, a pressure force at free ends 31, 41, 51 for example while the holder 7 is maintained, causing the displacement of the unitary connector 1 with friction toward the down part of the frame 70.

In the illustrated example of FIG. 3, the frame 70 is substantially square with a number of four identical openings 71, 72, 73, 74 in each of them a unitary connector 1 is mounted.

The functions of this holder 7 are as follows:

retention of a plurality of unit connectors 1 according to the invention;

grouping of the unitary connectors 1;

guiding the connectors before the connection with the complementary connection elements is ensured.

The holder 7 is preferably in plastics material but it can also be in metal.

Figure 4A:
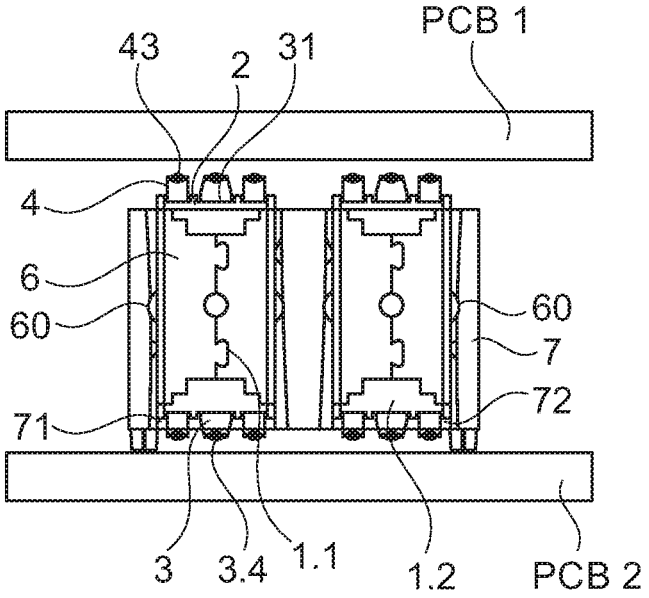
FIGS. 4A and 4B are side views of an exemplary connection module according to the invention, showing respectively the step of positioning the module on the down PCB and the step of achieving the board-to-board connection with the top PCB thanks to the deflection of the contact strips of the unitary connectors according to the first embodiment.
Figure 4B:
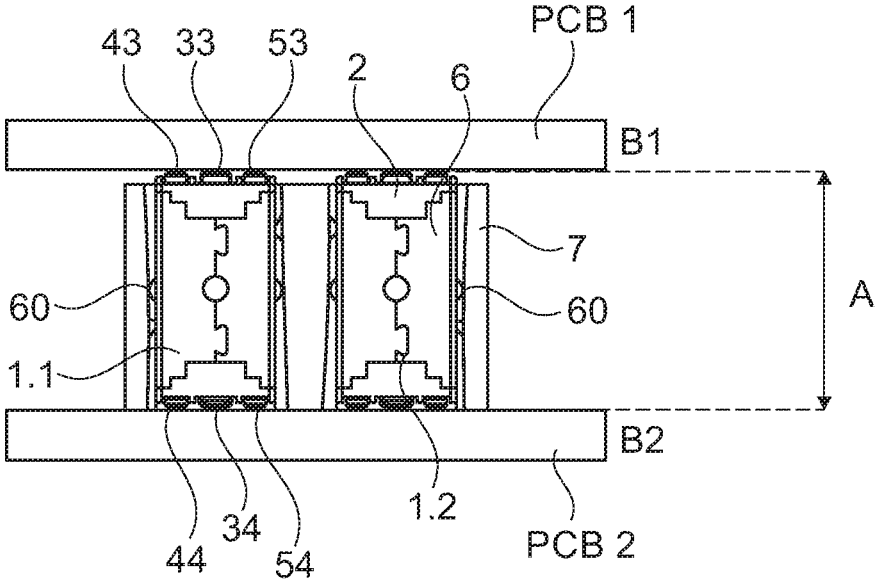

As shown on FIGS. 4A and 4B, in relation with a board-to-board connection, the holder 7 which accommodates several unitary connectors 1 is positioned onto the down PCB 2, with the free ends of the contacts facing the contact tracks of the PCB 2. Once the positioning made, the top PCB 1 is displaced toward the down PCB 2, causing the simultaneous deflection of all the free ends 31, 32; 41, 42; 51, 52 both of the ground contacts 4, 5 and of the central contact 3. The contacts points 33, 34; 43, 44; 53, 54 are positioned very precisely, whatever the misalignment tolerance between the two PCB1, PCB2.

As a sum-up, two parallel PCB1, PCB2 can realize a good electrical contact through compression of the contact points. The coplanar signal transmission between PCB1 and PCB2 can be realized by controlling the width of the free ends 31, 32; 41, 42; 51, 52 as well as their gap. As a result, good RF or HSDL signal performances are guaranteed. The floating mounting of the unitary connectors enables the equilibrium of forces and divides equally the compression of the spring in each free end.

The height of the holder 7 could be up to 20 or 25 mm, whereas the height of a unitary connector 1 may be of 4 mm, 5 mm and 7 mm.

A same holder 7 may accommodate a large number of unitary connectors 1.

Figure 5:
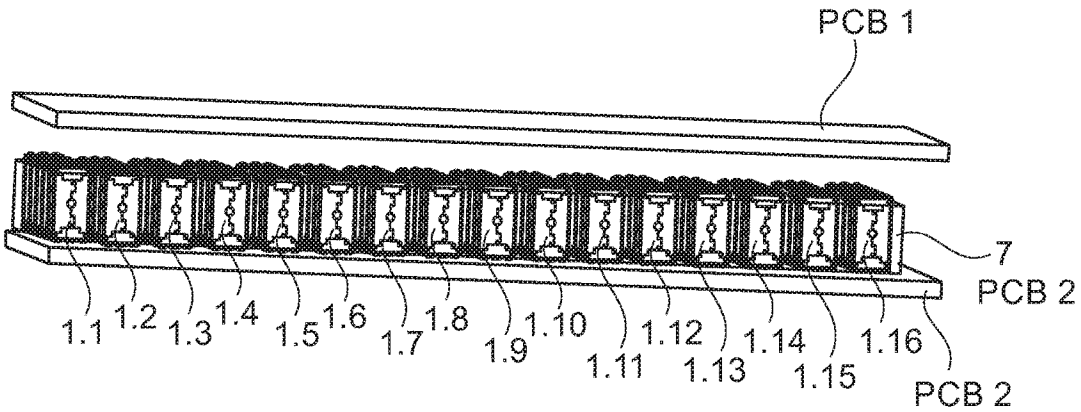
FIG. 5 is a perspective view similar to FIGS. 4A and 4B, but with a large numbers of unitary connectors according to the invention, thus achieving a multiple parallel board-to-board interconnection.

Thus, as shown on FIG. 5, a same holder 7 may have a large number of openings arranged in a single plane to accommodate several unitary connectors. In this shown example, there are two rows in a single plane including sixteen connectors 1.1 to 1.16 per a row. In other words, the connection module can be configured in a ganged configuration with a holder 7 in which a plurality of unitary connectors are arranged according to a floating mounting for a multiple parallel interconnection, which is good for a modularization.

Figure 6:
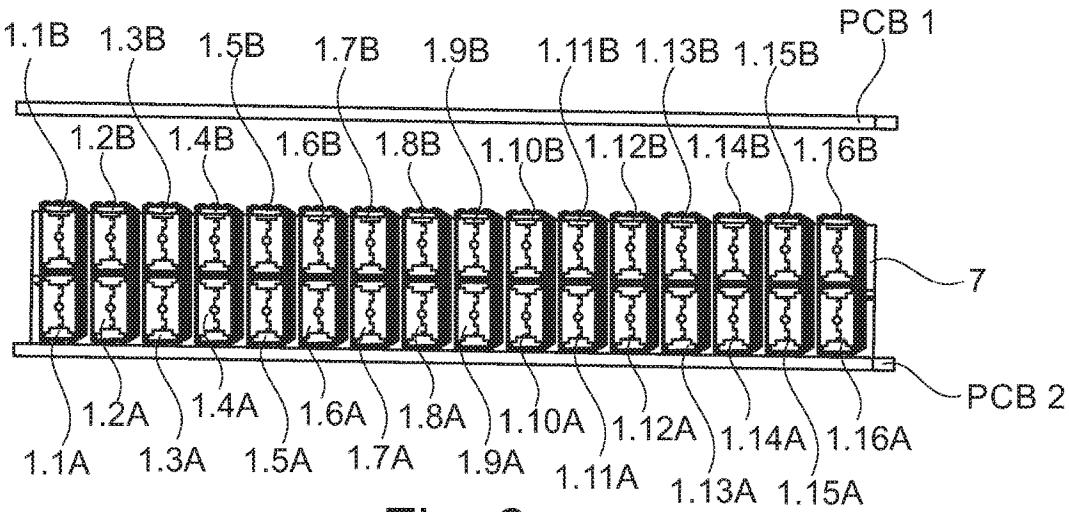
FIG. 6 is a perspective view similar to FIGS. 4A and 4B, but with a large numbers of unitary connectors according to the invention and stacked on two adjacent planes, thus achieving not only a multiple parallel board-to-board interconnection but also an interconnection with a different height than in FIG. 5.

As shown on FIG. 6, it is also possible to stack the unitary connectors 1 in a same holder 7. In the illustrated example, they are two planes of two rows including each sixteen connectors 1.1A to 1.16A and 1.1B to 1.16B, which are stacked. The possibility to stack the unitary connectors 1 according to the invention facilitates to achieve different heights of board to board connections. Besides, stacking unitary connectors 1 allows to gain axial tolerance in a board-to-board connection and to gain modularity.

Figure 7:
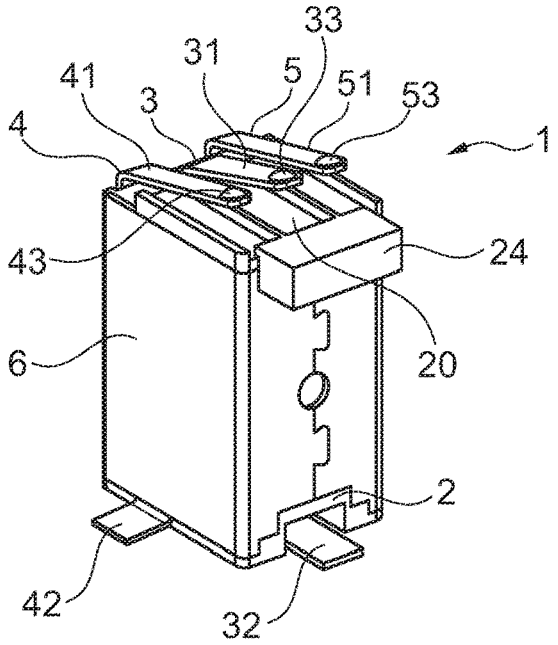
FIG. 7 is a perspective view of a unitary connector assembly according to a second embodiment of the invention.
Figure 8:
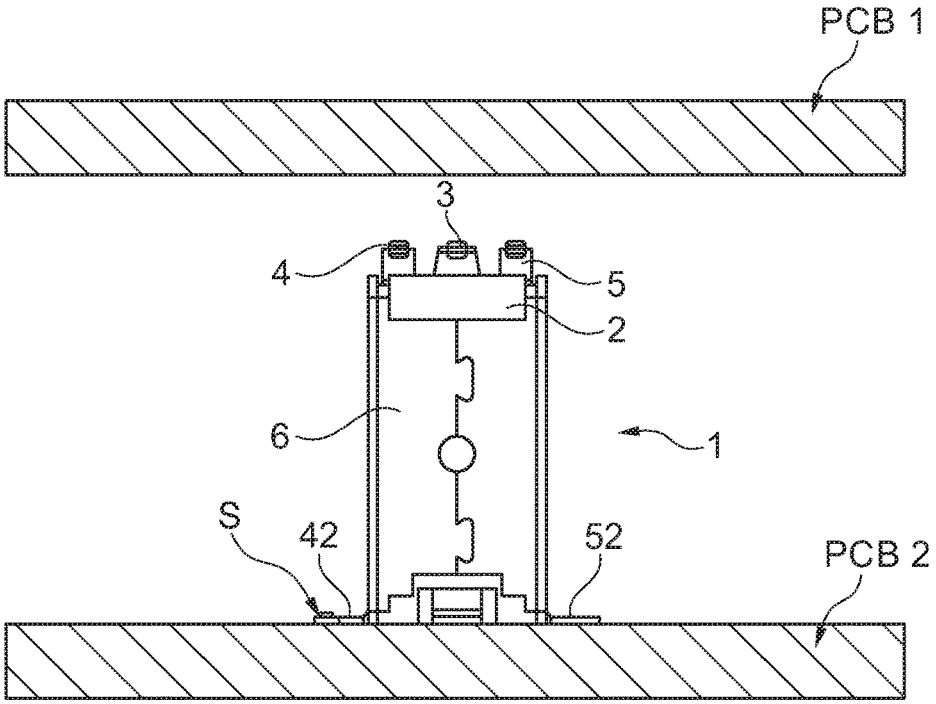
FIG. 8 is a side view of a unitary connector according to the second embodiment, showing the step of positioning and welding the free ends of the connector to the down PCB of the board-to-board connection.

A second embodiment of a unitary connector 1 is shown on FIGS. 7 and 8. Only one of the free ends 31, 41, 51 respectively of the central contact 3 and of the ground contacts 4, 5 are again configured as the one of the first embodiment, i.e. incurved toward the end face 21 of the insulating body 2 and configured as a spring.

On the contrary, the other free ends 32, 42, 52 are each configured as a rigid tab in order to be welded S to a contact of a complementary connection element PCB2.

In this second embodiment according to which one end 22 of the unitary connector is to be welded on the PCB, there is provided a picking pad 24 which is used to position the unitary connector on the PCB2 with a conventional "pick and place" equipment.

Figure 9:
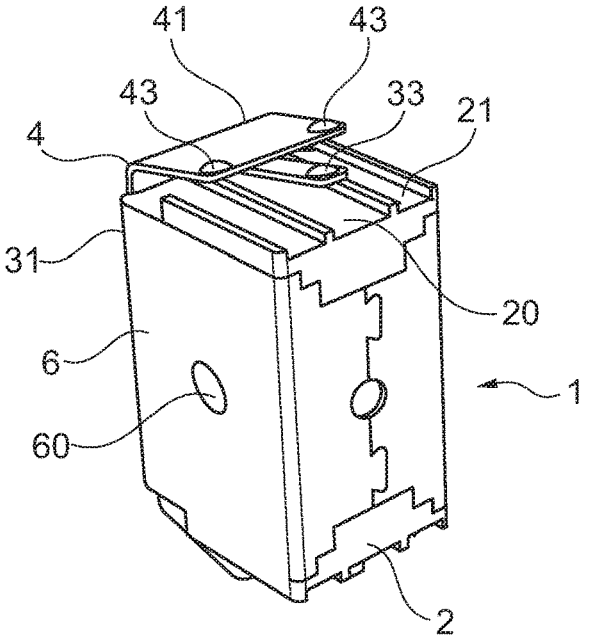
FIGS. 9 and 9A are respectively a perspective and a side view of a variant of the unitary connector according to the invention.
Figure 9A:
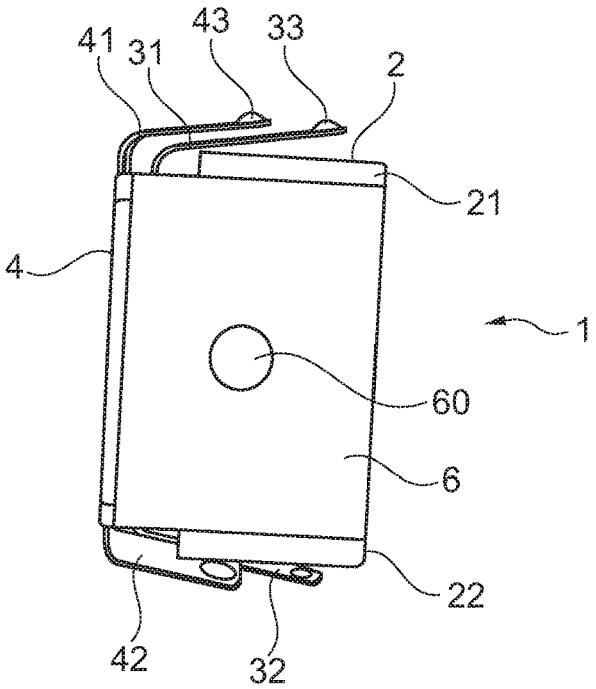

On FIGS. 9 and 9A, it is shown a variant of a central contact 3 under the shape of micro-strip retained inside the insulating body 2, and with only one large ground strip 4 which is retained outside the body 2.

Figure 10:
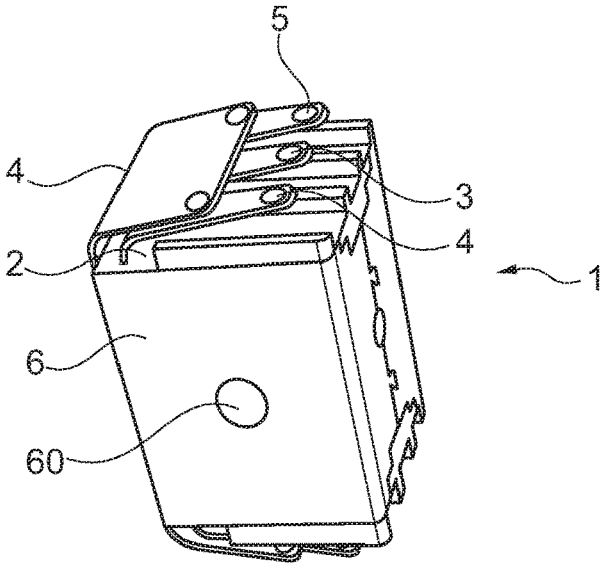
FIGS. 10 and 10A are respectively a perspective and a side view of another variant of the unitary connector according to the invention.
Figure 10A:
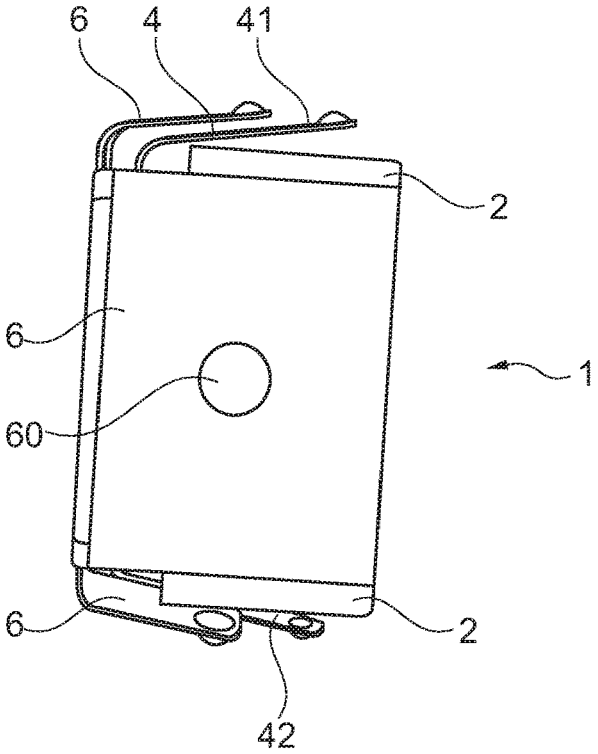

Another variant is shown on FIGS. 10 and 10A: two ground strips 4, 5 are coplanar to the central strip 3 and retained inside the insulating body 2. Outside the body 2, there is a large strip 6 with a flexible part forming an electromagnetic shield of the central line A constituted by the central strip 3 and the insulating body 2.

Figure 11:
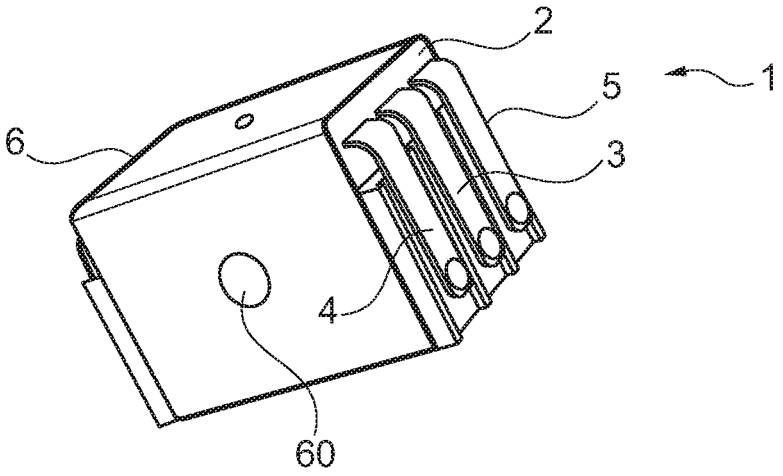
FIG. 11 is a perspective view of another variant of the unitary connector according to the invention.

FIG. 11 is another variant with a coplanar signal line 3, 4, 5 and a simple RF shield 6 which differs from the variant shown on FIGS. 10 and 10A by the fact that the shield 6 has no flexible part which is arranged outside the flexible end 31, 41, 51 of the strips 3, 4, 5 forming the coplanar line 3, 4, 5.

Figure 12:
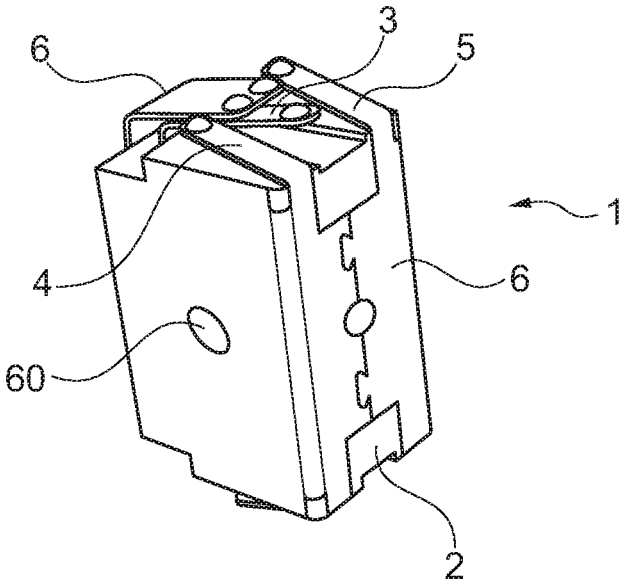
FIG. 12 is a perspective view of another variant of the unitary connector according to the invention.

The variant shown of the FIG. 12 allows increasing the maximum frequency to be transmitted by the connector 1 up to some 15 GHz. The association of the double grounding created by the strip 6 of the ground of the RF flexible line with the grounding of the flexible strips 4 and 5, homogenizes the current flow in the ground of the RF rigid line.

Other variants and enhancements can be provided without in any way departing from the framework of the invention.

The expression "comprising a" should be understood to be synonymous with "comprising at least one", unless otherwise specified.

The invention claimed is:

1. A unitary RF connector, intended in particular to link two printed circuit boards, comprising:

a central rigid RF line comprising a conductive element rigidly retained within an electrical insulating body which is rigid and comprises two end faces;

at least one flexible RF line comprising a conductive element linked to the conductive element of the central rigid line and being able to flex toward one of the end faces of the insulating body taking a closer position to the one of the end faces when acted upon by a pressure force of a complementary connection element;

an electromagnetic shield of the central rigid RF line, which is retained outside the insulating body, wherein the electromagnetic shield comprises flexible cuts or tabs allowing a floating mounting of the unitary RF connector into a holder.

2. The unitary RF connector according to claim 1, wherein each of the end faces of the insulating body comprises grooves, each groove being capable of accommodating a flexible end of a conductive element of the flexible RF line in order to mechanically protect said conductive element even in case of a high pressure force of the complementary connection element.

3. The unitary RF connector according to claim 1, wherein the central contact is made of high strength bronze, such as CuBe2.

4. Use of the unitary RF connector according to claim 1, to transmit RF (radiofrequency) signals or HSDL (High Speed Data Link) signals.

5. The unitary RF connector according to claim 1, wherein the central rigid RF line comprises a central portion of a first strip forming a central contact;

a central portion of at least a second strip forming a ground contact.

6. The unitary RF connector according to claim 5, wherein the flexible RF line is constituted by at least one free end of the first and the second strips.

7. The unitary RF connector according to claim 5, wherein both free ends of each of the ground and the central contacts of the flexible RF line are incurved toward an end face of the insulating body and are each configured as a spring.

8. The unitary RF connector according to claim 5, wherein only one free end of each of the ground and the central contacts is a flexible spring, the other free end of each of the ground and the central contacts being configured as a rigid tab in order to be weld to a contact of a complementary connection element.

9. The unitary RF connector according to claim 5, wherein each flexible end of the ground or central contact strip comprises an embossment forming a contact point.

10. The unitary RF connector according to claim 5, the central rigid RF line comprising the ground contact, or comprising the ground contact and another ground contact, retained outside the insulating body.

11. The unitary RF connector according to claim 5, the central rigid RF line comprising the ground contact, or comprising the ground contact and another ground contact, retained within the insulating body.

12. The unitary RF connector according to claim 5, wherein the ground contact and the electromagnetic shield are made of stainless steel.

13. A connection module, intended to be used to link two printed circuit boards comprising:

at least the unitary RF connector according to claim 1;

the holder comprising a frame with at least one opening in which the at least one unitary RF connector is accommodated according to a floating mounting.

14. The connection module according to claim 13, the frame comprising a plurality of openings arranged in a single plane in each of which the at least one unitary RF connector is accommodated according to a floating mounting.

15. The connection module according to claim 13, the frame comprising a plurality of openings arranged in at least two stacked planes in each of which the at least one unitary RF connector is accommodated according to a floating mounting.

16. The unitary RF connector according to claim 5, wherein the central portion of the ground contact is shaped as a shell surrounding the insulating body and forming the electromagnetic shield.

17. Process for manufacturing the unitary connector according to claim 16, comprising the following steps:

stamping a sheet of metal, preferably a stainless steel, to shape the at least the second strip forming the ground contact and the shell;

stamping a sheet of metal, preferably a high strength bronze, to shape the central contact;

positioning and maintaining the central contact relative to the ground contact; and insert molding an insulating material to form the insulating body retaining inside the central portion of the central contact and outside the central portion of the ground contact.

* * * * *